US007744953B2

(12) United States Patent
Huang et al.

(10) Patent No.: US 7,744,953 B2
(45) Date of Patent: Jun. 29, 2010

(54) METHOD FOR FORMING SELF-CLEANING COATING COMPRISING HYDROPHOBICALLY-MODIFIED PARTICLES

(75) Inventors: Yuan-Chang Huang, Keelung (TW); Yuung-Ching Sheen, Hsinchu (TW); Yih-Her Chang, Hsinchu (TW); Kuo-Feng Lo, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 656 days.

(21) Appl. No.: 11/318,566

(22) Filed: Dec. 28, 2005

(65) Prior Publication Data

US 2006/0147705 A1 Jul. 6, 2006

(30) Foreign Application Priority Data

Dec. 30, 2004 (GB) ..... 0428550.8

(51) Int. Cl.
*B05D 3/02* (2006.01)

(52) U.S. Cl. ..... 427/180; 427/189; 427/194; 427/385.5; 427/387; 427/388.1; 427/389.7; 427/393.5; 427/393.6; 427/421.1; 427/427.4; 427/427.5; 427/427.6; 427/427.7; 427/428.01; 427/429; 427/430.1; 427/435

(58) Field of Classification Search ..... None
See application file for complete search history.

(56) References Cited

U.S. PATENT DOCUMENTS

| | | | | |
|---|---|---|---|---|
| 5,747,561 | A | 5/1998 | Smirnov et al. | |
| 6,287,639 | B1 * | 9/2001 | Schmidt et al. | 427/387 |
| 6,323,268 | B1 * | 11/2001 | Fisher et al. | 524/266 |
| 6,335,037 | B1 * | 1/2002 | Ichinohe et al. | 424/490 |
| 6,455,103 | B1 * | 9/2002 | Mennig et al. | 427/165 |
| 6,534,176 | B2 * | 3/2003 | Terase et al. | 428/403 |
| 6,800,354 | B2 * | 10/2004 | Baumann et al. | 428/141 |
| 2002/0016433 | A1 | 2/2002 | Keller et al. | |
| 2004/0014865 | A1 | 1/2004 | Keller et al. | |
| 2004/0026832 | A1 | 2/2004 | Gier et al. | |
| 2004/0081818 | A1 * | 4/2004 | Baumann et al. | 428/323 |

FOREIGN PATENT DOCUMENTS

| | | | |
|---|---|---|---|
| CN | 1511902 | A | 7/2004 |
| EP | 1479738 | * | 11/2004 |
| GB | 2 251 860 | A | 7/1992 |
| JP | 62-149743 | | 7/1987 |
| JP | 1-304104 | | 12/1989 |
| JP | 8-176345 | | 7/1996 |
| JP | 10-204322 | | 8/1998 |
| WO | WO 94/09074 | | 4/1994 |

* cited by examiner

*Primary Examiner*—Erma Cameron
(74) *Attorney, Agent, or Firm*—Birch, Stewart, Kolasch & Birch, LLP

(57) ABSTRACT

A method for forming self-cleaning coating comprising hydrophobically-modified particles. Micro- or nano-particles are treated with a hydrophobic agent and an additive to form larger particles with the hydrophobic agent and the additive bonded thereto. A binder or crosslinker is attached to the larger particles by forming chemical bonds with at least one of the additive, the hydrophobic agent, and the particles, thus forming a coating material capable of forming self-cleaning coating.

22 Claims, No Drawings

METHOD FOR FORMING SELF-CLEANING COATING COMPRISING HYDROPHOBICALLY-MODIFIED PARTICLES

CROSS-REFERENCE TO RELATED APPLICATIONS

The subject matter of this application relates to that of copending application Ser. No. 10/318,459, filed Dec. 28, 2005, for "Method for forming aggregate material and the material formed thereby", both of which are assigned to a common assignee with this application. The disclosure of the copending application is incorporated herein by reference.

BACKGROUND

The present invention relates in general to coating technology. More particularly, it relates to a method for forming a material capable of forming a self-cleaning surface on an object.

The wettability of solid surfaces is a very important property, and is governed by both the chemical composition and geometrical microstructure of the surface. Currently, hydrophobic surfaces with water contact angle higher than 130° are arousing much interest because they will bring great convenience in daily life as well as in many industrial processes. Various phenomena, such as snow sticking, contamination or oxidation, are expected to be inhibited on such a surface.

An important application for these hydrophobic surfaces is the production of self-cleaning coatings based on their water and dirt repellency. These self-cleaning coatings not only provide value-added products with a high potential to save on cleaning and other maintenance cost, but also are good for ecobalance of the coated product, since cleaning chemicals no longer pollute the water and since energy is saved by reducing or eliminating maintenance cycles.

Conventionally, hydrophobic surfaces have been produced mainly in two ways. One is to create a rough structure on a hydrophobic surface, and the other is to modify a rough surface by materials with low surface free energy. Unfortunately, both approaches have several issues to deal with. Most hydrophobic coatings with surface roughness do not exhibit sufficient mechanical strength and adhesion, which results in short lifetimes. Others modified with low surface energy materials generally do not exhibit sufficient hydrophobicity (contact angle with water>130°) or adhesion.

Accordingly, the invention is generally directed to formation of a durable self-cleaning coating with improved mechanical strength and adhesion while maintaining a high water contact angle for the self-cleaning effect to work.

SUMMARY

In a first aspect, the invention provides a method for forming a self-cleaning coating on a substrate. The method includes forming a coating material by providing micro- or nano-particles; treating the particles with a hydrophobic agent and an additive capable of reaction with the particles to form larger particles with the hydrophobic agent and the additive bonded thereto; and attaching a binder or crosslinker to the larger particles by forming chemical bonds with at least one of the additive, the hydrophobic agent, and the particles. The method further includes: applying the coating material to the substrate; and drying or curing the coating material to form a solid coating having a microstructured, hydrophobic surface.

In a second aspect, the invention provides an object having a surface, at least a portion of which is coated with a self-cleaning coating by the method according to the third aspect of the invention.

DETAILED DESCRIPTION

The method of forming a coating material will be described here in greater detail. A self-cleaning coating with improved physical properties as well as sufficient surface hydrophobicity is obtained by chemical modification of the particle surfaces using an additive, a hydrophobic agent, and a binder or crosslinker. Other objects and advantages of the invention will become apparent from the following description.

In the invention, micro-particles with sizes varying from about 0.1 μm to 100 μm or nano-particles with sizes varying from about 1 nm to 100 nm may be used as starting materials for forming the coating material. Preferably, particles having a diameter of about 1-1000 nm are used. These particles are preferably particles prepared from wet synthesis process. Any known wet synthesis processes such as sol gel, hydrothermal, or precipitation process may be used. For example, the precursor includes water, solvent, and metal alkoxide. Examples of the metal alkoxide include tetramethoxysilane (TMOS), tetraethoxysilane (TEOS), titanium tetraisopropoxide, titanium tetramethoxide, titanium tetraethoxide, titanium tetrabutoxide and zirconium n-butoxide. The solvent may comprise an alcohol such as methanol, ethanol, isopropanol, or butanol. Other solvents, however, such as hexane, toluene, ketone or diethyl ether may be used. The sol gel precursors may be refluxed for an extended period, such as a period of above 5 minutes, preferably from 0.5 to 24 hours to yield the desired sol gel particles. For example, silicate gels may be prepared by hydrolyzing an alkoxide dissolved in an alcohol with a mineral acid or base, or organic acid or base.

It is to be understood that many types or grades of commercially available silica particles and colloidal silica may be used for the invention. Those skilled in the art will also recognize that although silica particles are preferred, any particles with —SiR, —TiR, —ZrR or —AlR groups, wherein R is OH, COOH, $NH_2$, $CONH_2$, NCO, SH, vinyl, or epoxy for proceeding condensation reactions may be used for the present invention.

In accordance with the invention, a hydrophobic agent and a functional additive are employed to chemically modify the aforementioned particles. The surfaces of the particles are modified by the hydrophobic agent to enhance the chemical hydrophobicity. The additive promotes hydrolysis and condensation reactions of the particles such that the particles grow into larger entities to physically increase hydrophobicity by providing surface roughness. Further, as an important feature of the invention, the additive also function as a coupling agent, which forms bonding with the particles on one side, and on the other side, forms bonding with a binder or crosslinker. As such, the additive attaches the binder or crosslinker to the particles.

Hydrophobic agents conventionally used in the art may be used herein for enhancing the chemical hydrophobicity of the particle surface. Frequently used hydrophobic agents include Si-based hydrophobic agents such as siloxane, silane, or silicone; F-based hydrophobic agents such as fluorosilanes, fluoroalkyl silanes (FAS), polytetrafluoroethylene (PTFE), polytrifluoroethylene, polyvinylfluoride, or functional fluoroalkyl compounds; and hydrocabon hydrophobic agents such as reactive wax, polyethylene, or polypropylene. A particularly preferred hydrophobic agent is polydimethylsiloxane (PDMS), a polymer with hydroxyl groups terminating the ends of each chain.

The additives used in the invention include those capable of promoting particle growth, having functional groups to react with both of the particles and a binder or crosslinker to function as a coupling agent that increases compatibility between particles and resins. Examples of such additives include alkoxysilanes having functional groups of vinyl, amino, epoxy, carboxyl, hydroxyl, or isocyanate. Illustrative examples include amino trialkoxysilane, vinyl trialkoxysilane, or epoxy trialkoxysilane. A particularly preferred additive in this case is (3-aminopropyl)triethoxysilane (APS).

The steps of treating the particles with the hydrophobic agent and the additive may take place ex-situ in an arbitrary order, or in-situ and simultaneously in one pot. For example, after forming a sol gel from sol gel precursors, the hydrophobic agent and the additive can be directly mixed and reacted at a temperature between 0-100° C. for minutes or hours, preferably 1-48 hours. The pH value of the reaction is preferably controlled at about 6.5-14, more preferably about 9-13 for the aggregation to proceed. As a result, a particle aggregate with the hydrophobic agent and the additive bonded on the surface thereof can be obtained.

As another important feature of the invention, the particle aggregate is chemically bonded with a binder or crosslinker. This can be accomplished by forming chemical bonds with the additive on the particle surfaces. Alternatively, the binder or crosslinker may be attached to the particles by forming chemical bonds with the hydrophobic agent on the particle or directly with the particles. The binder or crosslinker chemically bonded to the particle may increase the mechanical properties of the coatings, including adhesion and mechanical strength, without deteriorating the hydrophobicity. Suitable organic binders or crosslinkers used herein may include those conventionally used in the art and having reactive functional groups such as vinyl, amino, epoxy, carboxyl, hydroxyl, or isocyanate. Preferred examples include epoxy resins, polyureathanes, polyesters, acrylic resins, polyamides, and silicone resins.

The reaction of the binder or crosslinker may be carried out immediately following the additive treatment. For example, when the additive treatment is completed, the binder or crosslinker is added to the reaction mixture and reacted at a temperature between 0-100° C. for 1 minute to 48 hours.

It will be appreciated that the order of these reactions may be reversed. For example, the method of the invention may also be carried out by adding the hydrophobic agent and the binder (or crosslinker) followed by adding the additive. Further, the present method is economically advantageous, since all the reactions may be carried out efficiently at room temperature in one pot.

The larger particles formed by the invention typically have sizes varying from about 100 nm to about 1000 μm. Preferably, the coating material may be prepared by reactions of 1-40 wt % of the particles, 0.1-20 wt % of the hydrophobic agent, 0.1-15 wt % of the additive, 1.4-11.2 wt % of organic binder or crosslinker, and residual amounts of solvent, based on the total weight of the coating material.

The coating material may be applied to a substrate by any known technique of forming a coating from a liquid, such as spin coating, dip coating, spray coating, brush coating, or roller coating. The coating may be dried or cured at a temperature between room temperature and 200° C. over a period of 1 minute to 48 hours. Note that the drying temperature and time may vary depending on the type of particles, melting point of the substrate, curing condition of used chemicals, and thickness of the coating.

Coatings of the invention generally have a water contact angle of at least 110°. In preferred embodiments, the hydrophobic coatings may exhibit a water contact angle of at least 130° or even 150°, and therefore can be used to produce self-cleaning coatings. Moreover, since the coatings generally exhibit improved adhesion and mechanical strength, they are particularly suitable for producing self-cleaning facade paints to increase the lifetime of facades. In some embodiments, coatings formed by the invention can withstand more than 2,000, or even more than 5,000 ASTM D2486 scrub test cycles. Other possible applications include providing anti-corrosive or anti-icing coatings for buildings, vehicles, and other structures. Surfaces which can be treated with the hydrophobic coating include glass, plastic, metal, ceramic, polymer, but can also include other materials or composites.

Without intending to limit it in any manner, the present invention will be further illustrated by the following examples.

EXAMPLE 4 g of TEOS, 1.5 g of 2-amino-2-methyl-1-propanol (AMP-95), 20 g of ethanol, and 1.1 g of water were mixed and reacted at room temperature for one hour. Thereafter, 0.4 g of PDMS and 2 g of APS were added to the reaction mixture and reacted at room temperature for 24 hours with the pH value controlled at about 11.5-12. Following this, 0.8 g of epoxy resin (BE-188EL, Chang Chun PetroChemical) were added and reacted at room temperature for 2 hours. The resulting aggregate material was applied to a polyvinyl chloride (PVC) substrate with a facade paint thereon by dip coating, and dried at room temperature for 24 hours.

Comparative Example 1

The same procedure as described in Example was repeated except that PDMS was not added.

Comparative Example 2

The same procedure as described in Example was repeated except that APS was not added.

Comparative Example 3

The same procedure as described in the Example was repeated except that APS was replaced by $NH_4OH$.

Comparative Example 4

The same procedure as described in the Example was repeated except that APS was replaced by KOH.

Comparative Example 5

The same procedure as described in the Example was repeated except that APS was replaced by 3-methacryloxypropyl trimethoxysilane (Z6030, Dow Corning).

Comparative Example 6

The same procedure as described in the Example was repeated except that APS was replaced by 3-glycidoxypropyl trimethoxysilane (Z6040, Dow Corning).

Comparative Example 7

The same procedure as described in the Example was repeated except that the epoxy resin (BE188EL) was not added.

Hydrophobicity of the coatings of the Example and Comparative Examples was measured by a commercial contact angle meter (FACE model, Kyowa Interface Science) using 25 μl of water. Coating adhesion was evaluated by grid adhesion test based on JIS K5400. A one-hundred-section grid (10×10 1 mm sections) was cut on the coated surface. 3M adhesive tape (Transparent Tape 600) was applied to the grid, rubbed to completely adhere to the coating, and then sharply removed (vertical to the surface). The number of sections remaining without damage was counted by visual inspection. "Pass" indicates no damage observed; conversely, "Fail" indicates at least one section damaged. Scrub resistance was evaluated using a commercial scrub tester (Wet Abrasion Scrub Tester 903, Sheen Instrument) in accordance with the method as defined in ASTM D2486. The results of measurement and evaluation are summarized in Table 1.

TABLE 1

| | Water contact angle | Grid adhesion test | Scrub resistance |
|---|---|---|---|
| Example | >155° | Pass | >2000 cycles |
| Comp. Example 1 | 96° | Pass | NA |
| Comp. Example 2 | 107° | Pass | NA |
| Comp. Example 3 | 133° | Fail | <2000 cycles |
| Comp. Example 4 | 110° | Fail | <2000 cycles |
| Comp. Example 5 | 109° | Pass | NA |
| Comp. Example 6 | 117° | Pass | NA |
| Comp. Example 7 | >155° | Fail | <2000 cycles |

As can be seen from Table 1, the coating formed from the coating material of the invention showed improved scrub resistance and adhesion over that of Comparative Examples with hydrophobicity not compromised.

While the invention has been described by way of example and in terms of preferred embodiment, it is to be understood that the invention is not limited thereto, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for forming a self-cleaning coating on a substrate, comprising the steps of:

forming a coating material by providing micro or nano-particles; treating the micro or nano-particles with a hydrophobic agent and an additive to form larger particles with the hydrophobic agent and the additive bonded thereto, wherein the step of treating the micro or nano-particles with the additive and the hydrophobic agent is effected at a pH of about 6.5-14, and wherein the additive promotes hydrolysis and condensation reactions of the micro or nano-particles such that the micro or nano-particles grow into the larger particles; and attaching a binder or crosslinker to the larger particles by reacting the binder or crosslinker with at least one of the additive, the hydrophobic agent, and the particles;

applying the coating material to the substrate; and drying or curing the coating material to form a solid coating having a microstructured, hydrophobic surface, wherein the hydrophobic surface of the coating is such that water forms a contact angle of at least 130°.

2. A method as claimed in claim 1, wherein the hydrophobic surface of the coating is such that water forms a contact angle of at least 150°.

3. The method as claimed in claim 1, wherein the step of providing micro or nano-particles comprises:

providing wet synthesis process precursors;

reacting the wet synthesis process precursors to form the micro or nano-particles.

4. The method as claimed in claim 3, wherein the wet synthesis process precursors comprise water, solvent, and metal alkoxide.

5. The method as claimed in claim 4, wherein the metal alkoxide is selected from the group consisting of tetramethoxysilane, tetraethoxysilane, titanium tetraisopropoxide, titanium tetramethoxide, titanium tetraethoxide, titanium tetrabutoxide, and zirconium n-butoxide.

6. The method as claimed in claim 1, wherein the particles comprise a functional group selected from the group consisting of —SiR, —TiR, —ZrR and —AlR groups, wherein R is OH, COOH, $NH_2$, $CONH_2$, NCO, SH, vinyl, or epoxy.

7. The method as claimed in claim 6, wherein the particles are commercially available silica particles.

8. The method as claimed in claim 1, wherein the micro- or nano-particles have diameters between about 1 nm and 100 μm.

9. The method as claimed in claim 1, wherein the larger particle has a size between about 100 nm-1000 μm.

10. The method as claimed in claim 1, wherein the additive comprises a functional group for bonding with the binder or crosslinker.

11. The method as claimed in claim 10, wherein the functional group is selected from the group consisting of vinyl, amino, epoxy, carboxyl, hydroxyl, and isocyanate.

12. The method as claimed in claim 11, wherein the additive comprises functional alkoxysilane.

13. The method as claimed in claim 12, wherein the additive is selected from the group consisting of amino trialkoxysilane, vinyl trialkoxysilane, and epoxy trialkoxysilane.

14. The method as claimed in claim 1, wherein the hydrophobic agent comprises Si-based materials.

15. The method as claimed in claim 1, wherein the hydrophobic agent is selected from the group consisting of F-based materials and hydrocarbon materials.

16. The method as claimed in claim 1, wherein the binder or crosslinker comprises a functional group selected from the group consisting of vinyl, amino, epoxy, carboxyl, hydroxyl, and isocyanate.

17. The method as claimed in claim 16, wherein the binder or crosslinker is selected from the group consisting of epoxy resins, polyureathanes, polyesters, acrylic resins, polyamides, and silicone resins.

18. A method as claimed in claim 1, wherein the coating material is applied to the substrate using spin coating, dip coating, spray coating, brush coating, or roller coating.

19. A method as claimed in claim 1, wherein the step of drying or curing the coating material is conducted at a temperature between room temperature and 200° C.

20. A method as claimed in claim 1, wherein the substrate is selected from the group consisting of glass, metal, ceramic, and polymer.

21. A method as claimed in claim 1, wherein the coating withstands more than 2,000 ASTM D2486 scrub test cycles.

22. The method as claimed in claim 1, wherein the coating passes a JIS K5400 grid adhesion test.

* * * * *